US006450264B1

(12) United States Patent
Christian

(10) Patent No.: US 6,450,264 B1
(45) Date of Patent: Sep. 17, 2002

(54) SPRINKLER SYSTEM

(76) Inventor: William Christian, 532 Lincoln Ave., Alameda, CA (US) 94501

( * ) Notice: Subject to any disclaimer, the term of this patent is extended or adjusted under 35 U.S.C. 154(b) by 33 days.

(21) Appl. No.: 09/697,978

(22) Filed: Oct. 26, 2000

(51) Int. Cl.[7] ..... A62C 35/00
(52) U.S. Cl. ..... 169/16; 169/13; 239/208; 239/209
(58) Field of Search ..... 169/16, 13; 239/208, 239/209

(56) References Cited

U.S. PATENT DOCUMENTS

| | | | | | |
|---|---|---|---|---|---|
| 647,875 | A | * | 4/1900 | Pieperbrink | 169/16 |
| 1,644,603 | A | * | 10/1927 | O'Neill | 169/16 |
| 1,831,880 | A | * | 11/1931 | Pierce | 169/16 |
| 3,425,630 | A | * | 2/1969 | Fessler, Sr. | 239/208 |
| 3,583,490 | A | | 6/1971 | McFadden | |
| 3,889,881 | A | * | 6/1975 | Cunningham et al. | 239/208 |
| 4,330,040 | A | | 5/1982 | Ence et al. | |
| 4,372,493 | A | * | 2/1983 | Smith | 239/208 |
| 4,991,657 | A | | 2/1991 | Lelande, Jr. | |
| 5,125,458 | A | | 6/1992 | Berman | |
| 5,165,482 | A | | 11/1992 | Smagac et al. | |
| 5,692,571 | A | | 12/1997 | Jackson | |
| 5,732,511 | A | | 3/1998 | Scott | |

* cited by examiner

*Primary Examiner*—Lesley D. Morris
*Assistant Examiner*—Dinh Q. Nguyen

(57) ABSTRACT

A sprinkler system for preventing brush and forest fires from engulfing a home. The sprinkler system includes a piping assembly being adapted to extend along a peak of a roof of a building and along an underside of eaves of the building and along a fence line; and also includes a shield assembly including an elongate shield member being adapted to extend along the peak of the roof of the building and also including shield support members being adapted to fasten to the roof of the building for supporting the elongate shield member; and further includes a water supply assembly being connected to the piping assembly for supply water to the piping assembly; and also includes a pump/control assembly being connected to the water supply assembly and to the piping assembly for delivering water to the piping assembly.

8 Claims, 5 Drawing Sheets

SPRINKLER SYSTEM

BACKGROUND OF THE INVENTION

1. Field of the Invention

The present invention relates to a fire preventive sprinkler system and more particularly pertains to a new sprinkler system for preventing brush and forest fires from engulfing a home.

2. Description of the Prior Art

The use of a fire preventive sprinkler system is known in the prior art. More specifically, a fire preventive sprinkler system heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,330,040; 5,732,511; 5,165,482; 5,692,571; 5,125,458; 4,991,657; and 3,583,490.

While these devices fulfill their respective, particular objectives and requirements, the aforementioned patents do not disclose a new sprinkler system. The inventive device includes a piping assembly being adapted to extend along a peak of a roof of a building and along an underside of eaves of the building and along a fence line; and also includes a shield assembly including an elongate shield member being adapted to extend along the peak of the roof of the building and also including shield support members being adapted to fasten to the roof of the building for supporting the elongate shield member; and further includes a water supply assembly being connected to the piping assembly for supply water to the piping assembly; and also includes a pump/control assembly being connected to the water supply assembly and to the piping assembly for delivering water to the piping assembly.

In these respects, the sprinkler system according to the present invention substantially departs from the conventional concepts and designs of the prior art, and in so doing provides an apparatus primarily developed for the purpose of preventing brush and forest fires from engulfing a home.

SUMMARY OF THE INVENTION

In view of the foregoing disadvantages inherent in the known types of fire preventive sprinkler system now present in the prior art, the present invention provides a new sprinkler system construction wherein the same can be utilized for preventing brush and forest fires from engulfing a home.

The general purpose of the present invention, which will be described subsequently in greater detail, is to provide a new sprinkler system which has many of the advantages of the fire preventive sprinkler system mentioned heretofore and many novel features that result in a new sprinkler system which is not anticipated, rendered obvious, suggested, or even implied by any of the prior art fire preventive sprinkler system, either alone or in any combination thereof.

To attain this, the present invention generally comprises a piping assembly being adapted to extend along a peak of a roof of a building and along an underside of eaves of the building and along a fence line; and also includes a shield assembly including an elongate shield member being adapted to extend along the peak of the roof of the building and also including shield support members being adapted to fasten to the roof of the building for supporting the elongate shield member; and further includes a water supply assembly being connected to the piping assembly for supply water to the piping assembly; and also includes a pump/control assembly being connected to the water supply assembly and to the piping assembly for delivering water to the piping assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sprinkler system which has many of the advantages of the fire preventive sprinkler system mentioned heretofore and many novel features that result in a new sprinkler system which is not anticipated, rendered obvious, suggested, or even implied by any of the prior art fire preventive sprinkler system, either alone or in any combination thereof.

It is another object of the present invention to provide a new sprinkler system which may be easily and efficiently manufactured and marketed.

It is a further object of the present invention to provide a new sprinkler system which is of a durable and reliable construction.

An even further object of the present invention is to provide a new sprinkler system which is susceptible of a low cost of manufacture with regard to both materials and labor, and which accordingly is then susceptible of low prices of sale to the consuming public, thereby making such sprinkler system economically available to the buying public.

Still yet another object of the present invention is to provide a new sprinkler system which provides in the apparatuses and methods of the prior art some of the advantages thereof, while simultaneously overcoming some of the disadvantages normally associated therewith.

Still another object of the present invention is to provide a new sprinkler system for preventing brush and forest fires from engulfing a home.

Yet another object of the present invention is to provide a new sprinkler system which includes a piping assembly being adapted to extend along a peak of a roof of a building and along an underside of eaves of the building and along a fence line; and also includes a shield assembly including an elongate shield member being adapted to extend along the peak of the roof of the building and also including shield support members being adapted to fasten to the roof of the building for supporting the elongate shield member; and further includes a water supply assembly being connected to the piping assembly for supply water to the piping assembly; and also includes a pump/control assembly being connected to the water supply assembly and to the piping assembly for delivering water to the piping assembly.

Still yet another object of the present invention is to provide a new sprinkler system that allows the homeowner to protect one's house from being destroyed due to a forest fire.

Even still another object of the present invention is to provide a new sprinkler system that would be easy and convenient to install upon one's property.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
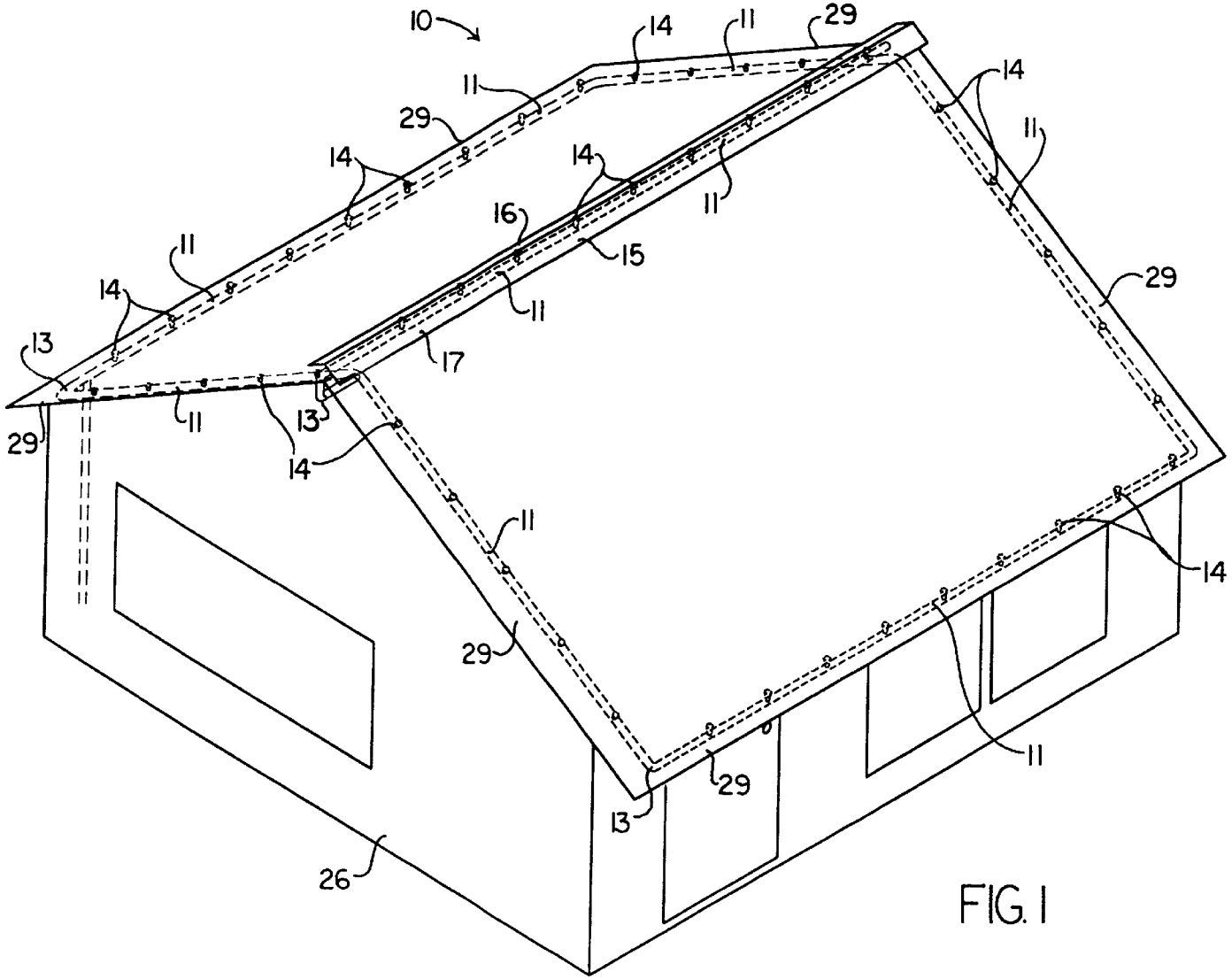
FIG. 1 is a perspective view of a new sprinkler system according to the present invention.
Figure 2:
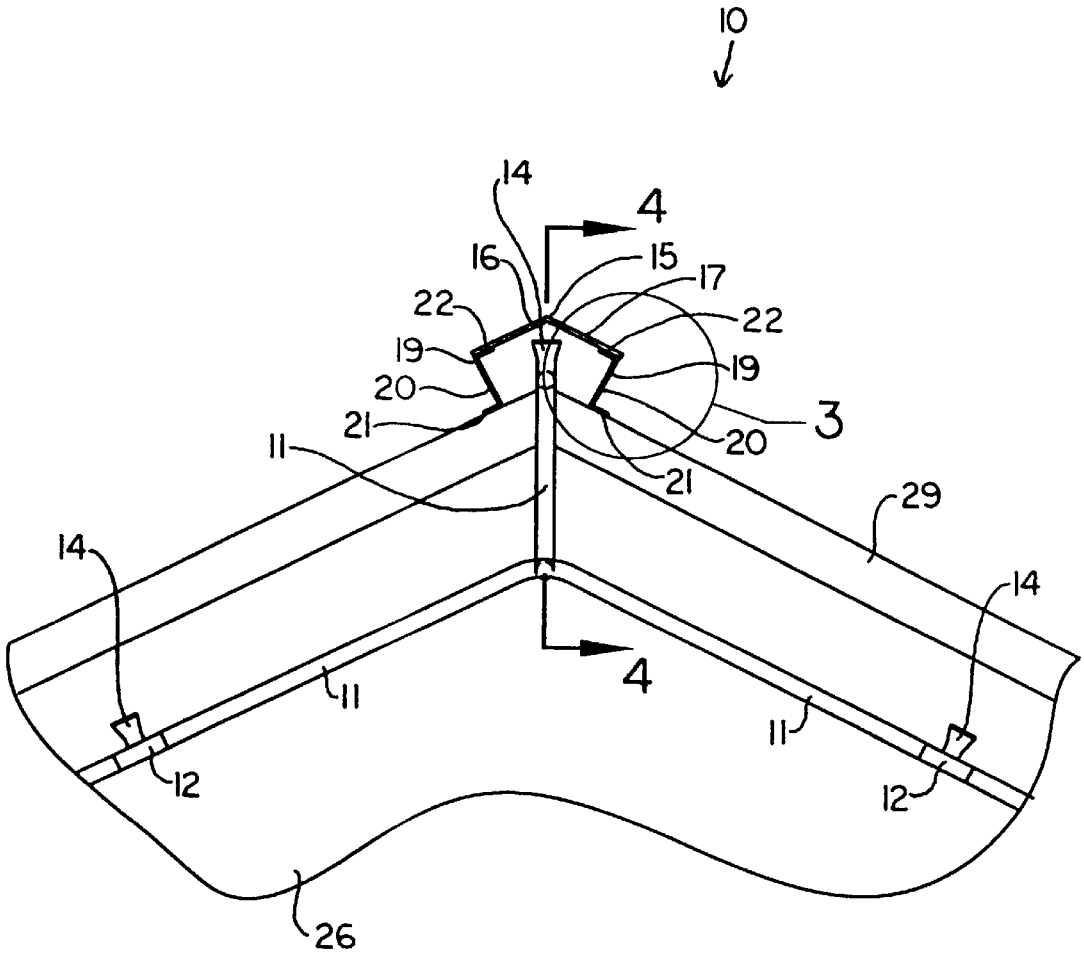
FIG. 2 is an end elevational view of the present invention.
Figure 3:
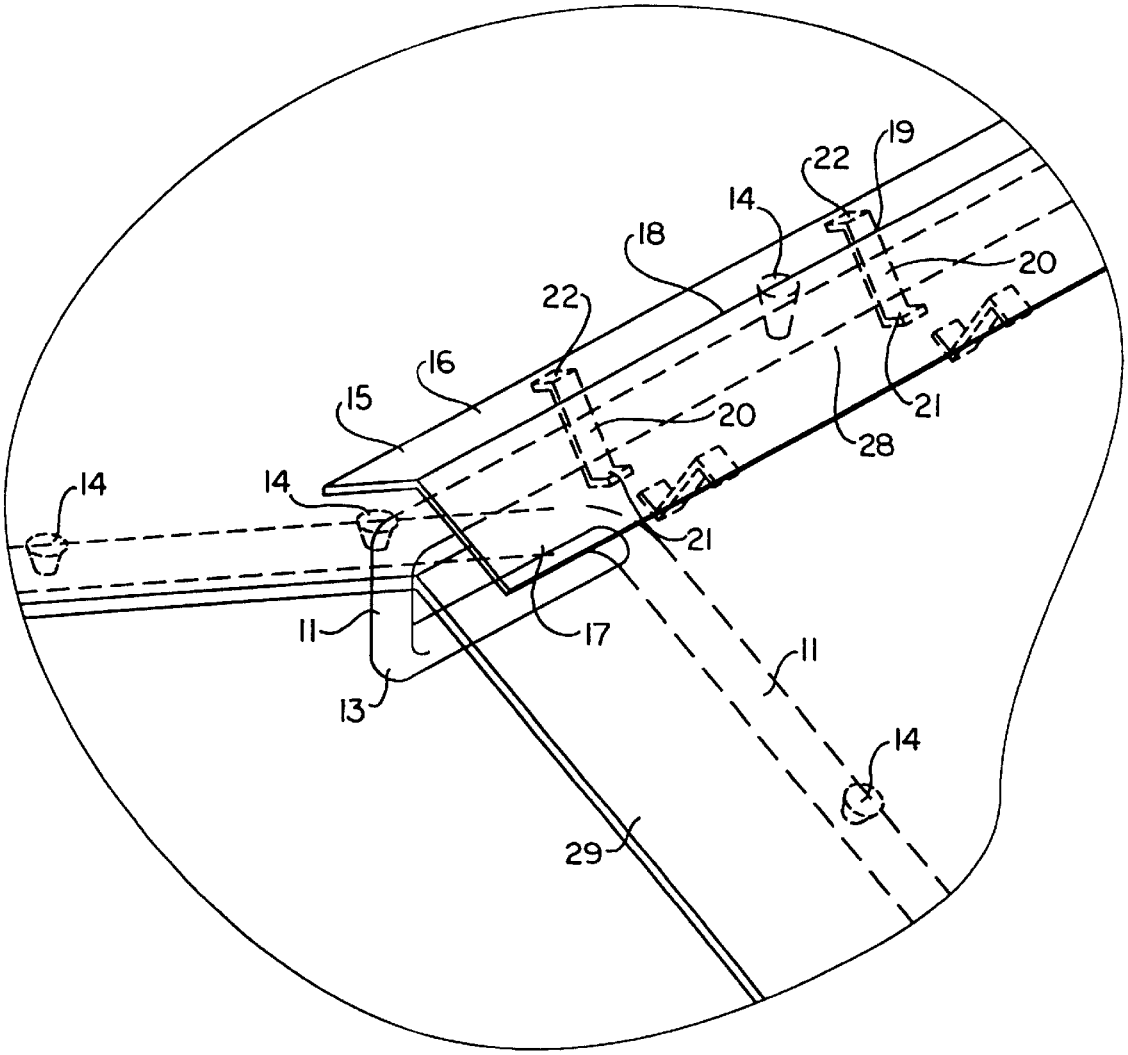
FIG. 3 is a detailed perspective view of the present invention.
Figure 4:
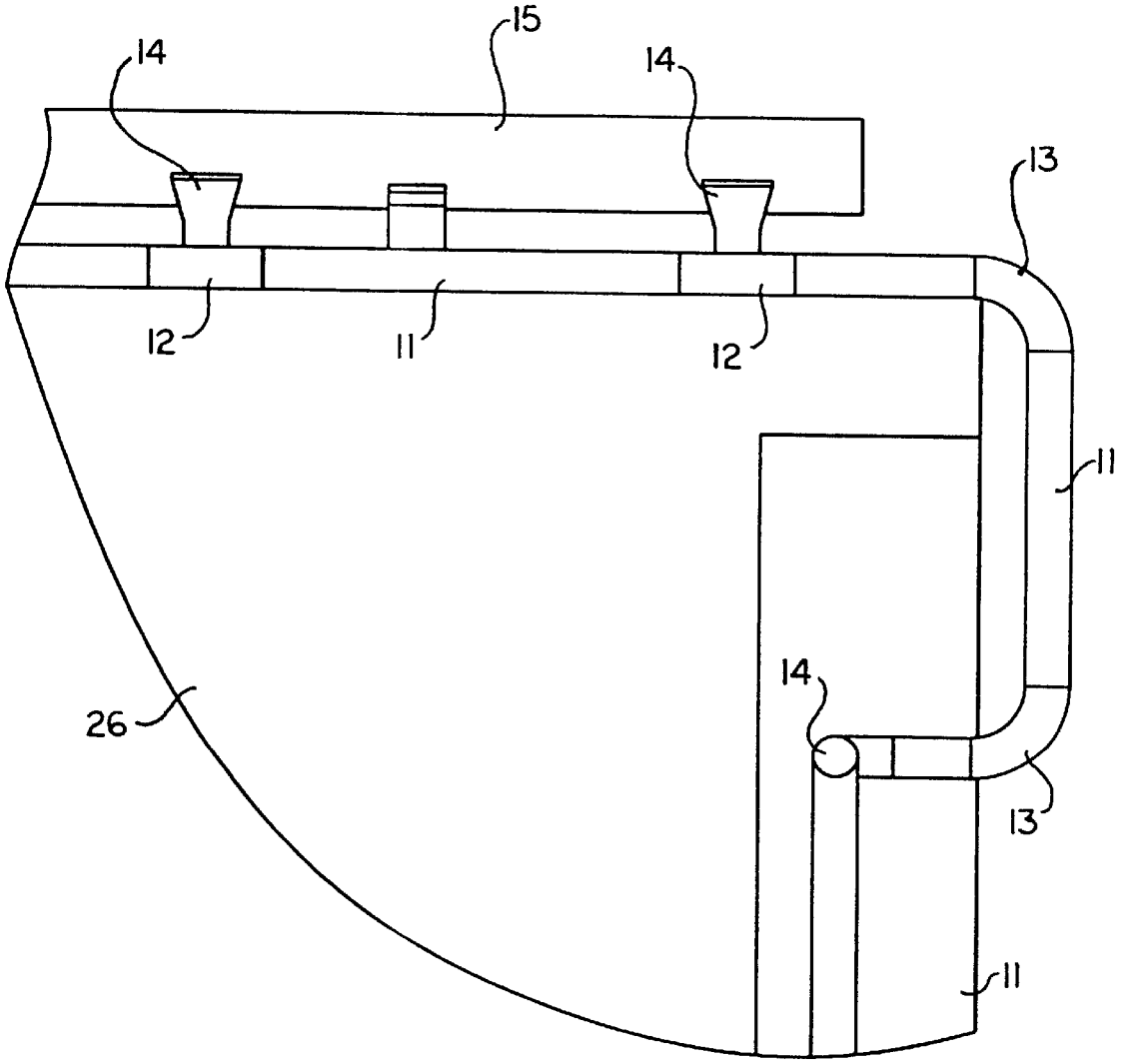
FIG. 4 is a partial side elevational view of the present invention.
Figure 5:
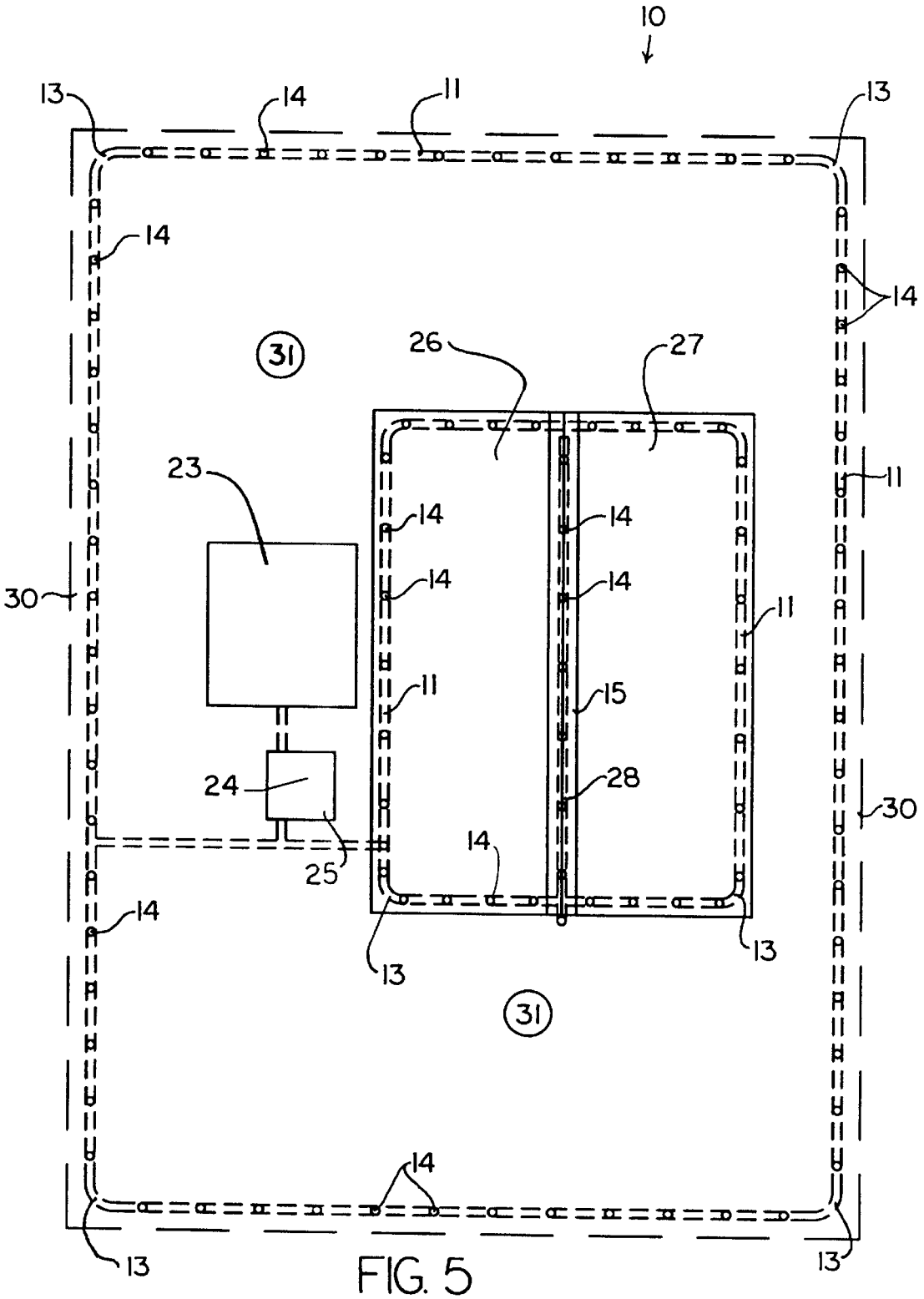
FIG. 5 is a top plan view of the present invention.

With reference now to the drawings, and in particular to FIGS. 1 through 5 thereof, a new sprinkler system embodying the principles and concepts of the present invention and generally designated by the reference numeral 10 will be described.

As best illustrated in FIGS. 1 through 5, the sprinkler system 10 generally comprises a piping assembly being adapted to extend along a peak 28 of a roof 27 of a building 26 and along an underside of eaves 29 of the building 26 and along a fence line 30. The piping assembly includes a plurality of pipes 11 being conventionally connected end-to-end with connectors 12 including elbows 13, and also includes a plurality of spray nozzles 14 being conventionally disposed inline of the pipes 11. The pipes 11 are adapted to be securely mounted upon and along the peak 28 of the roof 27 of the building 26 and are adapted to be suspended below the eaves 29 of the roof 27 of the building 26 and are adapted to be disposed in a ground 31 along the fence line 30. The elbows 13 are adapted to be positioned at ends of the peak 28 of the roof 27 of the building 26 and below the eaves 29 under the ends of the peak 28 of the roof 27 and at corners of the eaves 29 of the roof 27 to generally maintain a continuous connection of the pipes 11.

A shield assembly includes an elongate shield member 15 being adapted to extend along the peak 28 of the roof 27 of the building 26. The shield member 15 may have a generally concave underside for positioning above and orienting toward the peak of the roof of the building (see FIGS. 2 and 3), and the generally concave underside of the shield member may be substantially V-shaped. A portion of the plurality of pipes is located beneath the generally concave underside of the elongate shield member (see FIGS. 2 through 4). The shield assembly also includes shield support members 19 being adapted to fasten to the roof 27 of the building 26 for supporting the elongate shield member 15. The shield support members 19 are brackets 19 each having an elongate main portion 20 and a first end portion 21 and a second end portion 22 both being angled relative to the elongate main portion 20. The brackets 19 are adapted to be spaced along the peak 28 of the roof 27 of the building 26. The first end portions 21 of the brackets 19 are adapted to be securely and conventionally attached to the roof 27. The second end portions 22 of the brackets 19 are securely and conventionally attached to the elongate shield member 15. The elongate shield member 15 includes longitudinal side portions 16,17 which are angled relative to one another along a longitudinal axis of the elongate shield member 15 thus forming a crest 18 along the longitudinal axis of the elongate shield member 15. The elongate shield member 15 has an underside which is securely and conventionally attached to the second end portions 22 of the brackets 19 and which shields the piping assembly disposed upon the peak 28 of the roof 27 of the building 26 and which is adapted to be spaced above the peak 28 of the roof 27 of the building 26.

A water supply assembly 23 is conventionally connected to the piping assembly for supply water to the piping assembly with the water supply assembly including an underground cistern. A pump/control assembly is conventionally connected to the water supply assembly 23 and to the piping assembly for delivering water to the piping assembly. The pump/control assembly includes a conventional pump 24 being conventionally connected to the underground cistern 23 and to the piping assembly, and also includes a conventional control unit 25 being conventionally connected to the pump 24 for energizing the pump 24.

In use, the user would turn on the pump 24 using the control unit 25, and the pump 24 would pump water from the underground cistern 23 through the pipes 11 and through the spray nozzles 14 to cover the building 26 and the vegetation on the property with moisture and water to prevent the brush or forest fires from spreading onto the user's property and building 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sprinkler system comprising:

a piping assembly for extending along a peak of a roof of a building and along an underside of eaves of the building and along a fence line, said piping assembly including a plurality of pipes said piping assembly including a plurality of nozzles positioned at spaced locations on said plurality of pipes and extending outwardly from said plurality of pipes;

a shield assembly for extending along the peak of the roof of the building, said shielding assembly including an elongate shield member and shield support members for fastening to the roof of the building to support said elongate shield member, said shield member having a generally concave underside for positioning above and orienting toward the peak of the roof of the building;

a water supply assembly being connected to said piping assembly for supply water to said piping assembly; and a pump/control assembly being connected to said water supply assembly and to said piping assembly for delivering water to said piping assembly;

wherein a portion of said plurality of pipes is located beneath the generally concave underside of said elongate shield member, and a portion of said plurality of spray nozzles extend toward the generally concave underside of said elongate shield member to direct a spray of water upwardly against the generally concave underside of said elongate shield member.

2. A sprinkler system as described in claim 1, wherein the generally concave underside of said elongate shield member is substantially V-shaped.

3. A sprinkler system as described in claim 1, wherein said shield support members are brackets each having an elongate main portion and a first end portion for attaching to the roof at spaced locations along the peak thereof and a second end portion attached to said elongate shield member, said end portions being angled relative to said elongate main portion.

4. A sprinkler system as described in claim 2, wherein said elongate shield member includes longitudinal side portions which are angled relative to one another along a longitudinal axis of said elongate shield member forming a crest along said longitudinal axis of said elongate shield member.

5. A sprinkler system as described in claim 1, wherein said water supply assembly includes an underground cistern.

6. A sprinkler system as described in claim 5, wherein said pump/control assembly includes a pump being connected to said underground cistern and to said piping assembly, and also includes a control unit being connected to said pump for energizing said pump.

7. A sprinkler system as described in claim 2, wherein elbows are positioned at ends of the peak of the roof of the building and below the eaves under the ends of the peak of the roof and at corners of the eaves of the roof to generally maintain a continuous connection of said pipes.

8. A sprinkler system comprising:

a piping assembly for extending along a peak of a roof of a building and along an underside of eaves of the building and along a fence line, said piping assembly including a plurality of nozzles positioned at spaced locations on said plurality of pipes and extending outwardly from said plurality of pipes;

a shield assembly for extending along the peak of the roof of the building, said shielding assembly including an elongate shield member and shield support members for fastening to the roof of the building to support said elongate shield member, said shield member having a generally concave underside for positioning above and orienting toward the peak of the roof of the building;

a water supply assembly being connected to said piping assembly for supply water to said piping assembly; and a pump/control assembly being connected to said water supply assembly and to said piping assembly for delivering water to said piping assembly;

wherein a portion of said plurality of pipes is located beneath the generally concave underside of said elongate shield member, and a portion of said plurality of spray nozzles extend toward the generally concave underside of said elongate shield member to direct a spray of water upwardly against the generally concave underside of said elongate shield member;

wherein the generally concave underside of said elongate shield member is substantially V-shaped;

wherein said shield support members are brackets each having an elongate main portion and a first end portion for attaching to the roof at spaced locations along the peak thereof and a second end portion attached to said elongate shield member, said end portions being angled relative to said elongate main portion;

wherein said elongate shield member includes longitudinal side portions which are angled relative to one another along a longitudinal axis of said elongate shield member forming a crest along said longitudinal axis of said elongate shield member;

wherein said water supply assembly includes an underground cistern; and wherein said pump/control assembly includes a pump being connected to said underground cistern and to said piping assembly, and also includes a control unit being connected to said pump for energizing said pump.

* * * * *